United States Patent [19]

Griffin

[11] 4,408,543

[45] Oct. 11, 1983

[54] LABORATORY SUPPLY ARRANGEMENT

[75] Inventor: Brian C. Griffin, New South Wales, Australia

[73] Assignee: Brian Griffin Pty. Limited, New South Wales, Australia

[21] Appl. No.: 254,245

[22] Filed: Apr. 15, 1981

[30] Foreign Application Priority Data

Apr. 28, 1980 [AU] Australia ..... PE3307

[51] Int. Cl.[3] ..... A47B 85/00

[52] U.S. Cl. ..... 108/24; 108/50; 108/64; 312/195; 312/201; 312/209; 312/223

[58] Field of Search ..... 312/209, 223, 198, 201, 312/195; 108/64, 59, 24, 23, 114, 50; D24/1.1

[56] References Cited

U.S. PATENT DOCUMENTS

| | | | |
|---|---|---|---|
| 79,127 | 6/1868 | Johnson | 108/114 |
| D. 186,881 | 12/1959 | Ogg | 312/209 X |
| D. 188,418 | 7/1960 | Salvenson | D24/1.1 |
| 2,694,614 | 11/1954 | Dent | 108/60 X |
| 3,068,821 | 12/1962 | Hermans | 108/96 X |
| 3,181,484 | 5/1965 | Keepler | 312/209 X |
| 3,267,881 | 8/1966 | Saggione | 108/50 |
| 3,367,291 | 2/1968 | Evans | 108/64 |
| 3,437,390 | 4/1969 | Evans | 108/64 X |
| 3,920,299 | 11/1975 | Propst | 312/223 |
| 4,066,023 | 1/1978 | Hughes | 108/50 |
| 4,285,281 | 8/1981 | Frick | 108/144 X |

*Primary Examiner*—James T. McCall
*Attorney, Agent, or Firm*—Ladas & Parry

[57] ABSTRACT

A laboratory supply arrangement including a service tower and a plurality of table-like articles. The service tower has a riser tube and an outlet housing. The table-like articles are shaped to be complementary with a corresponding portion of the riser tube.

5 Claims, 5 Drawing Figures

LABORATORY SUPPLY ARRANGEMENT

The present invention relates to a laboratory supply arrangement or laboratory service system and in particular to a laboratory supply arrangement which permits the layout of the laboratory benches, for example, to be altered in order to suit different purposes to which the laboratory may be put during its life.

The traditional laboratory comprises a number of benches of a heavy and permanent nature which are supplied with plumbed fluid services, such as gas and water supplies, and also various electrical supplies such as A.C. and D.C. power supplies. This traditional arrangement suffers from the disadvantage that the benches are entirely inflexible and therefore it is impossible to re-arrange the benches in the laboratory without expending a substantial amount of money in order to practically re-construct the laboratory.

In order to overcome this disadvantage, it is known to provide overhead channel members which carry laboratory services and which are supplied by means, for example, of flexible tubing arranged in a spiral fashion decending from the overhead channel members down to the upper surface of the laboratory benches. Whilst this arrangement permits the benches to be moved, the overhead arrangement is extremely unsightly and restricts the line of sight of persons working in the laboratory.

In another prior art approach to overcome the abovementioned disadvantages of traditional laboratories, it is known to provide a plurality of service columns of large and substantially constant cross-section located at spaced intervals on the laboratory floor. The interior of such columns are filled with pipes carrying the plumbed fluid services and are also filled with electrical cables. The terminals for such fluid services, such as taps and gas outlets, and also the terminals for the electrical services, are provided on the sides of the services column at, and above, a height which corresponds to the upper surface of the laboratory benches.

Whilst this arrangement permits the laboratory benches to be moved independently of the services column, a severe disadvantage arises because it is not possible to surround the services column with, say, four benches and provide a continuous bench surface with adjacent edges of the bench surfaces abutting. The reason for this is that the bench surfaces must abut the services column in order to provide the smallest possible distance between the services terminals and the bench top. Therefore the cross-sectional dimensions of the services column produce a gap of equivalent dimension between the upper surfaces of adjacent benches.

It is the object of the present invention to overcome, or substantially ameliorate, the abovementioned disadvantages by the provision of a laboratory supply arrangement which permits relocation of the laboratory benches or tables and which also provides that adjacent surfaces of the bench or table tops can abut each other and also abut the structure providing the services to the laboratory.

According to one aspect of the present invention, there is disclosed a laboratory supply arrangement comprising a services tower and a more than two bench or table-like articles of furniture surrounding said tower, said services tower comprising a base, a narrow riser tube extending upwardly from said base above the upper surface of said table-like articles of furniture, and an outlet housing surmounting said tube, wherein electrical cables and at least some plumbed fluid services pass through said tube and into said housing, the terminals for said fluid services and electrical cables being mounted on the exterior of said housing and wherein a portion of the periphery of the upper surface of each of said table-like articles is shaped to be complementary with a corresponding portion of the cross-sectional shape of said tube whereby the surfaces of adjacent ones of said table-like articles can edge abut each other to provide a continuous working surface and also abut said riser tube.

An embodiment of the present invention will now be described with reference to the drawings in which.

Figure 1:
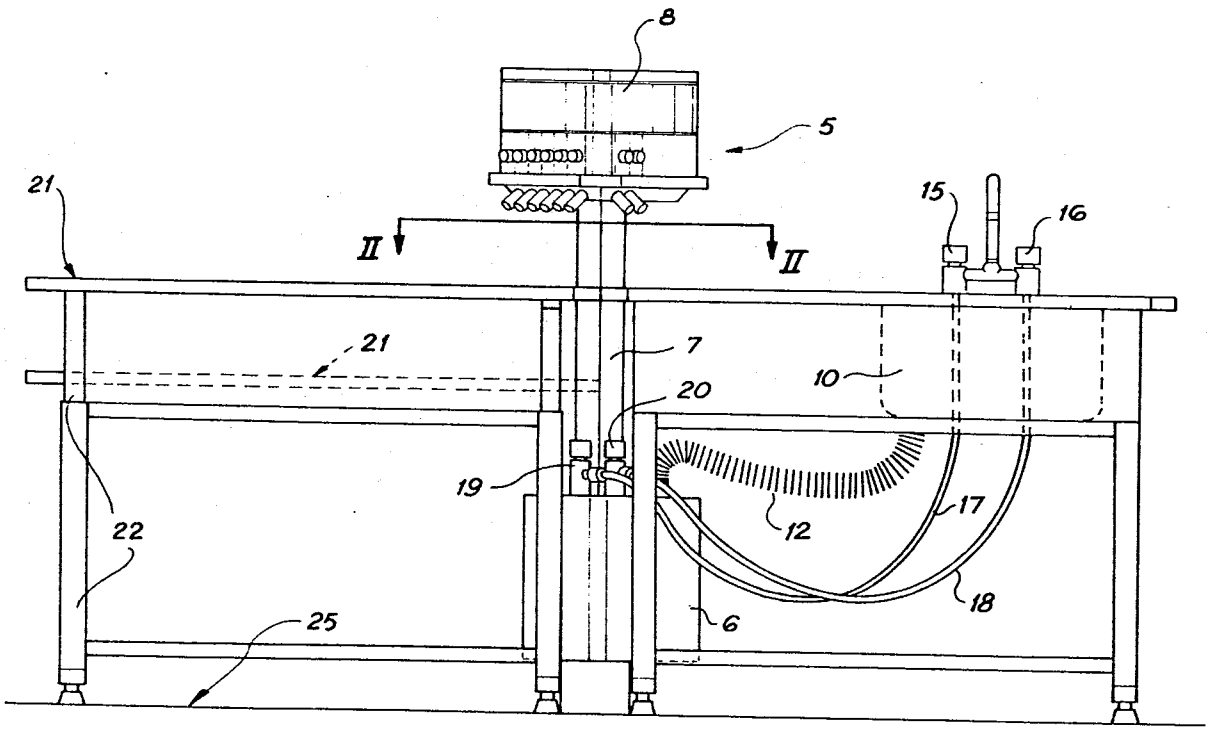
FIG. 1 is a side elevation of a services tower surrounded by four tables.
Figure 2:
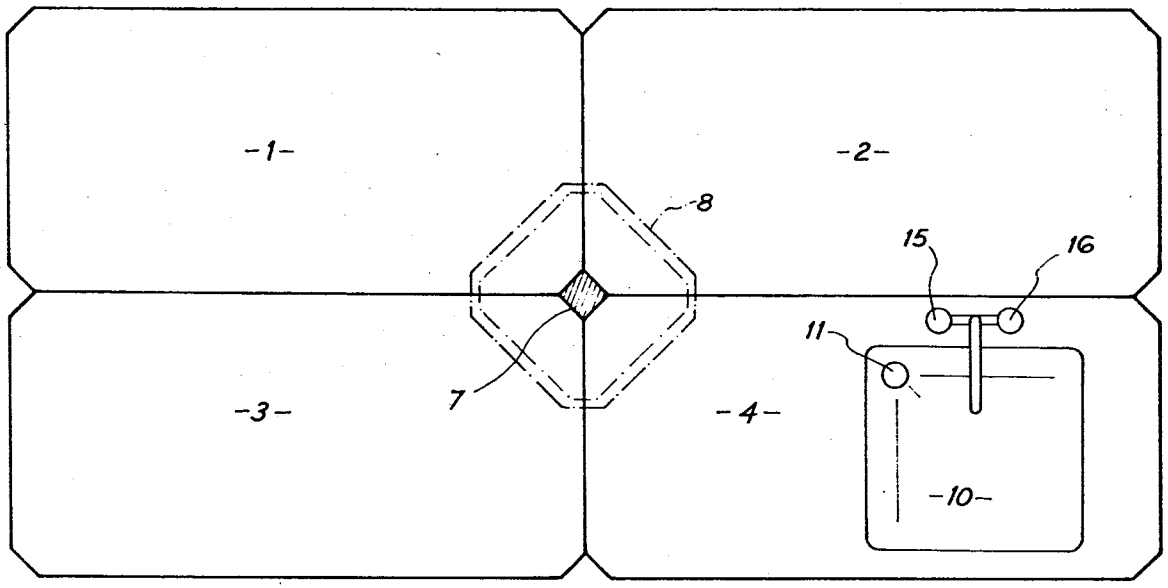
FIG. 2 is a plan sectional view taken along the line II—II of FIG. 1.

The general nature of the laboratory supply arrangement of the preferred embodiment may be seen from a consideration of FIGS. 1 and 2. The laboratory benches take the form of four free standing tables 1 to 4 respectively, which surround a services tower 5. The services tower 5 comprises a base 6 from which a narrow riser tube 7 extends upwardly, being surmounted by an outlet housing 8. The outlet housing 8 carries terminals for electric power supply and plumbed fluid services, such as gas supplies, which terminals will be described hereinafter in greater detail.

Figure 3:
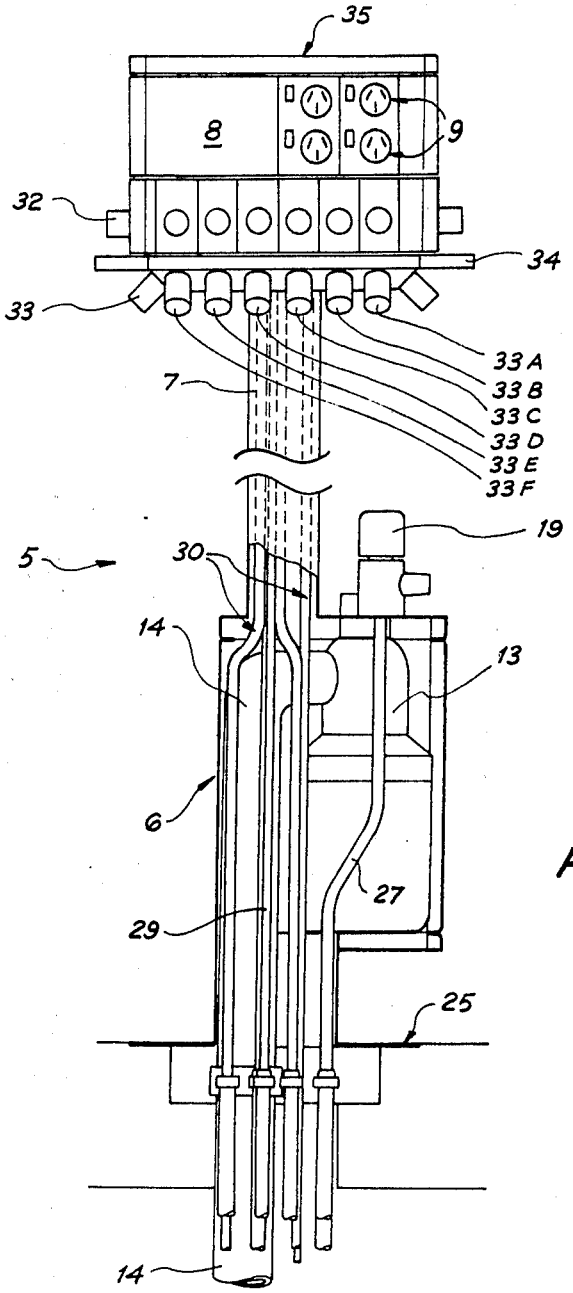
FIG. 3 is a side elevation, partly in section, of the services tower of FIG. 1.

One table 4 contains a sink 10 having an outlet 11 which is connected by means of a flexible hose 12 to the base 6 and thence to a bottle trap 13 and drain 14 (FIG. 3). In addition, the sink 10 includes a hot water tap 15 and cold water tap 16 which are supplied by means of flexible hoses 17 and 18 which extend from taps 19 and 20 mounted on the base 6.

It will be apparent that the tables 4 are lightweight free standing articles of furniture quite different from the conventional, heavy, permanently fixed laboratory benches. Furthermore, tables 1 to 3 inclusive have an adjustable height upper surface 21, the adjustment of which is brought about by means of telescopic legs 22. In this way, the position of the upper surface 21 of the tables 1 to 3 inclusive above floor level can be adjusted to transform the tables 1 to 3, as required, between laboratory benches and desks.

Figure 4:
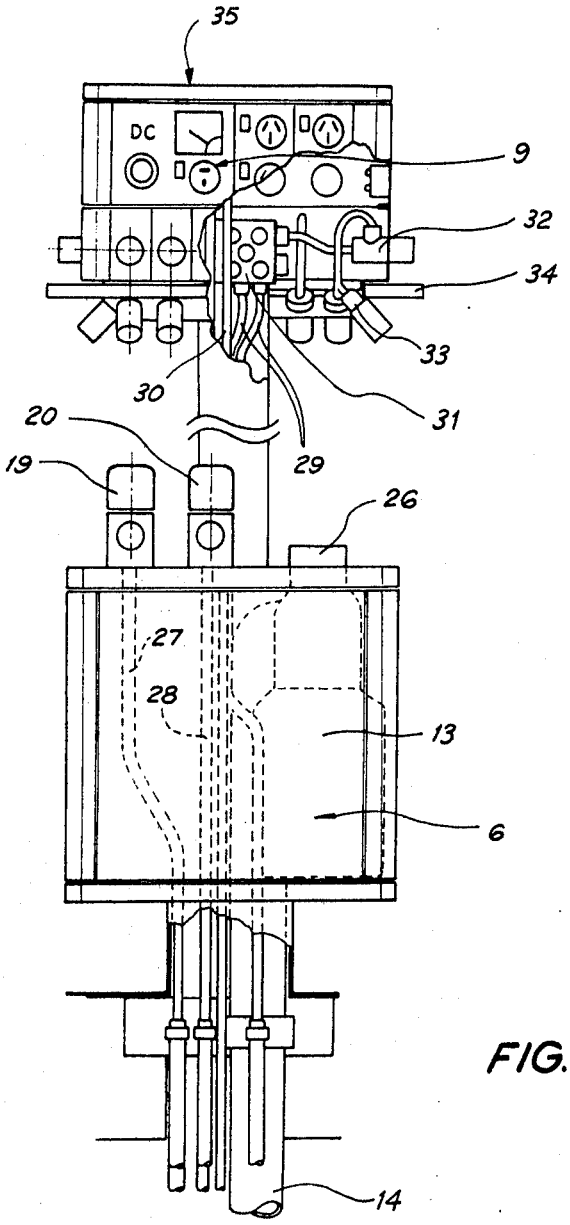
FIG. 4 is a front elevation, partly in section, of the services tower of FIG. 3.

Turning now to FIGS. 3 and 4, the construction of the services tower 5 is shown therein in more detail. Located under the floor 25 are conventional plumbing and electric cable services which extend upwardly through the floor 25 into the base 6. Included within the base 6 are the drain 14 which is connected via the bottle trap 13 to the drain inlet 26 (FIG. 4). The hot and cold water taps 19 and 20 are respectively supplied by means of hot and cold water supply pipes 27 and 28 which extend upwardly from below the floor 25 into the base 6.

In addition, gas supply pipes 29 and electrical conduits 30 extend from below the level of the floor 25, through the base 6, and through the narrow riser tube 7 so as to enter the outlet housing 8. Within the outlet housing 8 the gas supply pipes 29 terminate in junction box 31 from where each supply is directed to four corresponding gas controls 32 which in turn lead to a corresponding gas outlet 33.

There are six gas outlets, 33A to 33F which respectively supply carbon-dioxide, oxygen, nitrogen, vacuum, compressed air, and town gas. Each outlet 33 is controlled by the corresponding gas control 32 which preferably comprises a small orifice needle valve. A guard ring 34 extends around the outlet housing 8 so as to protect the gas controls 32 from being inadvertently bumped.

The outlet housing 8 also includes electrical terminals for D.C. and A.C. power supplies, as well as coaxial outputs for closed circuit television monitors, for example. Such monitors themselves can also be supported by the flat upper surface 35 of the outlet housing 8.

Figure 5:
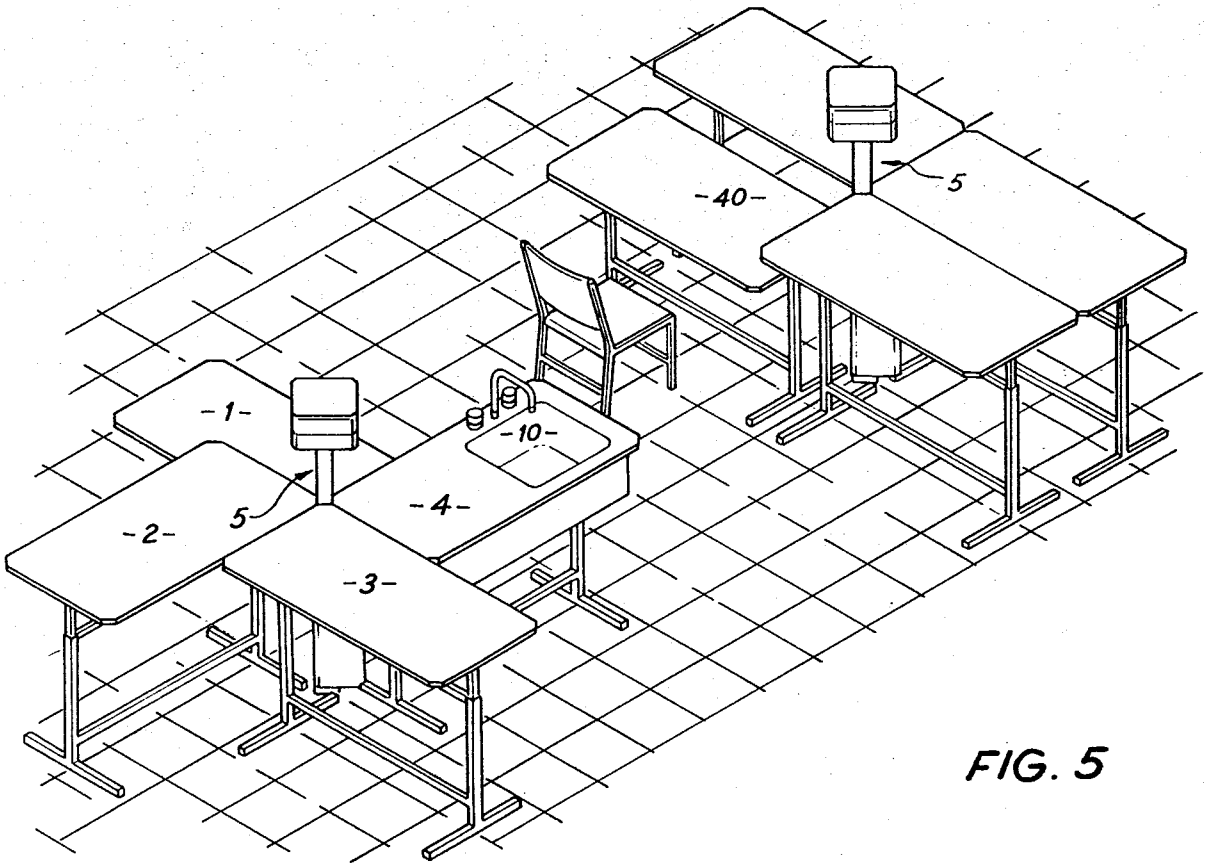
FIG. 5 is a perspective view of a portion of a laboratory showing the tables of FIGS. 1 and 2, re-arranged to a different configuration.

FIG. 5 shows a perspective view of a laboratory supplied with services in accordance with the preferred embodiment. In the portion of the laboratory shown, two services towers 5 are provided and the tables 1 to 4 of FIGS. 1 and 2 re-arranged into a different configuration from that illustrated in FIGS. 1 and 2. In this way, the flexibility of the preferred embodiment will be apparent since the configuration of tables of FIGS. 1 and 2 will lend itself to different types of experiment to which the configuration of tables shown in FIG. 5 lends itself.

Furthermore, as seen in FIG. 5, irrespective of the configuration of tables used, the upper surfaces 21 of adjacent tables abut each other and also abut the riser tube 7 so that there are no gaps between the surfaces. This represents a substantial improvement on the prior art since large, continuous, surfaces are often required in laboratories to support relatively large or bulky pieces of apparatus.

The table 40 of FIG. 5 is shown with its upper surface 21 lowered so as to convert the table 40 into the desk configuration from the laboratory bench configuration illustrated by the remainder of the tables.

The foregoing describes only one embodiment of the present invention and modifications, obvious to those skilled in the art may be made thereto without departing from the present invention. For example, the hot and cold water taps 19 and 20, can be located on the outlet housing 8 and the taps 15 and 16 can then be supplied by means of hoses 17 and 18 which are located above the upper surfaces 21 of the tables. However, this arrangement results in a more cluttered appearance in the laboratory.

It will also be apparent to those skilled in the art that whilst the riser tube 7 illustrated has a square or rectangular cross-section, and therefore the centre corners of the table 1 to 4, for example, are truncated by removal of a triangular portion thereof, this is not the only arrangement possible. If desired, the riser tube 7 can have a circular cross-section, in which case each of the central corners has a half semi-circular cut-out. In addition, it is not necessary that each corner of each table be truncated, however, this clearly increases the flexibility of the possible table configurations.

What I claim is:

1. A laboratory supply arrangement comprising a services tower and more than two bench or table-like articles of furniture surrounding said tower, said services tower comprising a base, a narrow riser tube extending upwardly from said base above the upper surface of said table-like articles of furniture, and an outlet housing surmounting said tube, wherein electrical cables and at least some plumbed fluid services pass through said tube and into said housing, the terminals for said fluid services and electrical cables being mounted on the exterior of said housing and wherein a portion of the periphery of the upper surface of each of said table-like articles is shaped to be complementary with a corresponding portion of the cross-sectional shape of said tube whereby the surfaces of adjacent ones of said table-like articles can edge abut each other to provide a continuous working surface and also abut said riser tube.

2. An arrangement as claimed in claim 1 wherein said plumbed fluid services passing through said tube comprise gas supply pipes; a bottle trap water drain, a hot water outlet and a cold water outlet are located adjacent said base; one of said articles of furniture includes a sink, and said water outlets and drain are connected to said sink by respective flexible conduits whereby the position of said article of furniture including said sink relative to said tower can be altered without dis-connecting said sink.

3. An arrangement as claimed in claim 1 wherein at least one of said table-like articles of furniture is adjustable to permit vertical adjustment of the height of the upper surface of said one table-like article.

4. An arrangement as claimed in claim 3 wherein said one table-like article has vertical tubular metal legs, an upper surface support being slidably retained in each leg.

5. An arrangement as claimed in claim 1 wherein the cross-sectional shape of said tube is square, the upper surface of each table-like article is rectangular, each corner of said upper surface has a triangular portion removed therefrom, the total area of said triangular portions being substantially equal to the area of said square.

* * * * *